United States Patent [19]

Tank

[11] 4,079,780

[45] Mar. 21, 1978

[54] REGENERATIVE HEAT-EXCHANGER OF A GAS TURBINE

[75] Inventor: Eggert Tank, Fellbach, Germany

[73] Assignee: Daimler-Benz Aktiengesellschaft, Germany

[21] Appl. No.: 746,067

[22] Filed: Nov. 30, 1976

[30] Foreign Application Priority Data

Dec. 2, 1975 Germany ..... 2554073

[51] Int. Cl.[2] ..... F28D 19/00

[52] U.S. Cl. ..... 165/8; 267/148; 74/446; 64/27 C

[58] Field of Search ..... 165/8, 10; 267/151, 267/147, 181, 148; 74/446; 64/27 C

[56] References Cited

U.S. PATENT DOCUMENTS

| | | | |
|---|---|---|---|
| 3,741,287 | 6/1973 | Mittman | 165/8 |
| 3,794,109 | 2/1974 | Hughes | 165/8 |
| 3,985,181 | 10/1976 | Guillot | 165/8 |

*Primary Examiner*—Albert W. Davis, Jr.
*Attorney, Agent, or Firm*—Craig & Antonelli

[57] ABSTRACT

A regenerative heat-exchanger of a gas turbine with a ceramic heat-exchanger disk, a metallic toothed rim substantially coaxially surrounding the heat-exchanger disk under formation of an annular space, compression springs arranged in the annular space which are supported under prestress, on the one hand, against the inside of the toothed rim and, on the other, against the outside of curved entrainment plate means; each entrainment plate means includes a support member and an adherent layer whose concave inner side abuts at the edge of the heat-exchanger disk, whereby the adherent layer essentially consists of metal fibers which form a plastically deformable felt-like adherent layer providing a good frictional engagement to transmit the driving torque to the heat-exchanger disk.

15 Claims, 4 Drawing Figures

REGENERATIVE HEAT-EXCHANGER OF A GAS TURBINE

The present invention relates to a regenerative heat-exchanger of a gas turbine whose ceramic heat-exchanger disk is coaxially surrounded by a metallic toothed rim under formation of an annular space, in which are arranged compression springs that are supported under prestress, on the one hand, against the inside of the toothed rim, and, on the other, against the outside or arcuate entrainment plates which consist of a sheet-metal support member and of an adherent layer whose concave inner side abuts at the edge of the heat-exchange disk.

In a known construction of this type (British Pat. No. 1,324,731), the adherent layer consists of an elastomer. This material, however, becomes brittle and fragile at temperatures above 300° C. At the higher operating temperatures which are frequently aimed at in gas turbine design, elastomers cannot be used therefore.

The present invention is therefore concerned with the task to eliminate this disadvantage and to provide an effective adherent layer which remains capable of proper functioning also at higher operating temperatures. This is realized according to the present invention in that the adherent layer consists of metal fibers which form a plastically deformable, felt-like cohesive layer. Such an adherent layer is characterized not only by great heat-resistance but above all by a very good adherence. The latter is achieved by the deformability of the adherent layer which permits a good adaptation to the disk edge, and furthermore by the high friction value of metal fibers as compared to ceramic materials.

Asbestos has already been proposed as a material for an adherent layer of an entrainment plate (German Offenlegungsschrift 1,936,996) which withstands the required high temperatures but which has a number of properties that render the same less suitable for an adherent layer. Thus, asbestos is only slightly yielding and not particularly wear- or abrasion-resistant. Additionally, asbestos has the undesired property of giving off water at high temperatures and to shrink whereby the uniform abutment of the adherent layer at the disk edge is impaired.

It is furthermore known in the art to arrange an undulated ring-shaped gauze wire between the heat-exchanger disk and the toothed rim (German Offenlegungsschrift 2,144,807). The adhering action of such a gauze wire, however, is only slight as a result of the essentially line-shaped contact. Additionally, the contact pressure of an undulated wire inset can be determined only inaccurately. Whereas with too low a pressure the gauze wire slips with the frequently shock-like loads, too large a pressure can lead to damages of the sensitive heat-exchanger disk by the gauze wire with the small existing abutment surfaces. In contrast thereto, the abutment or contact pressure can be determined accurately to an optimum value with the division of the task by the separate use of compression springs and entrainment plates.

According to the present invention, the adherent layer of the entrainment plate may be reinforced on its side facing the sheet metal support member by a wire-gauze or wire-mesh fabric. This measure permits a considerably better fastening of the adherent layer at the sheet-metal support member.

According to a further advantageous embodiment of the present invention, the adherent layer of the entrainment plate is secured at the sheet-metal support member by spot-welding. This type of fastening is simple and inexpensive and is characterized by a particularly good durability.

Accordingly, it is an object of the present invention to provide a regenerative heat-exchanger for a gas turbine which avoids by simple means the aforementioned shortcomings and drawbacks encountered in the prior art.

Another object of the present invention resides in a regenerative heat-exchanger of a gas turbine in which an adherent layer is provided which remains completely operable also at higher operating temperatures.

A further object of the present invention resides in a regenerative heat-exchanger of a gas turbine in which the entrainment plates do not involve any materials that become brittle and fragile at the higher temperatures which may be encountered in modern gas turbines.

A further object of the present invention resides in a regenerative heat-exchanger of a gas turbine which permits a good adaptation of the entrainment plates to the circumferential disk edge.

Still a further object of the present invention resides in a regenerative heat-exchanger of the type described above in which the entrainment plates abut substantially uniformly against the outer surface of the ceramic heat-exchanger disk under all operating conditions and in which the contact pressure can be determined accurately for its optimum value.

These and further objects, features and advantages of the present invention will become more apparent from the following description when taken in connection with the accompanying drawing which shows, for purposes of illustration only, one embodiment in accordance with the present invention, and wherein.

Figure 1:
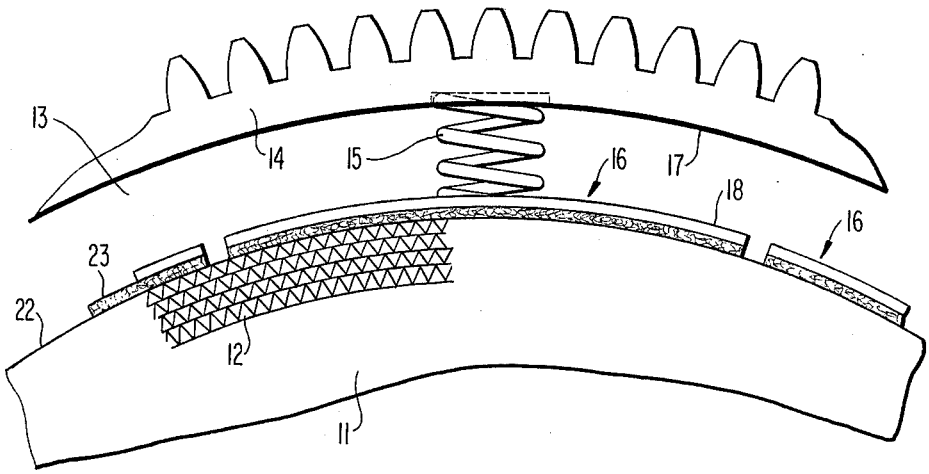
FIG. 1 is a somewhat schematic partial elevational view of an entrainment plate in accordance with the present invention arranged in a regenerative heat-exchanger.
Figure 2:
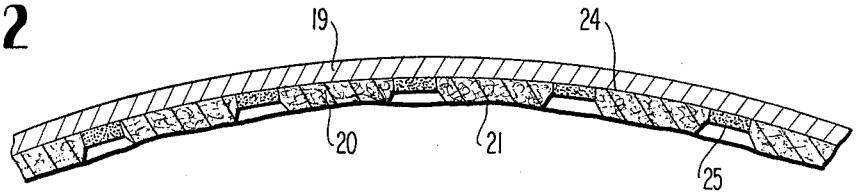
FIG. 2 is a partial longitudinal cross-sectional view, on an enlarged scale, through the entrainment plate in accordance with the present invention, illustrated in FIG. 1.
Figure 4:
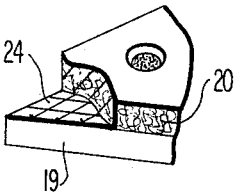
FIG. 4 is a partial perspective view of the entrainment plate in accordance with the present invention, partly broken away to illustrate certain details thereof.
Figure 3:
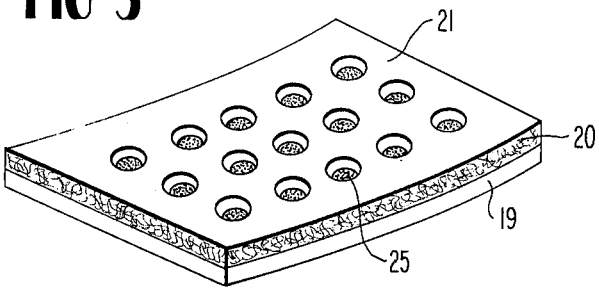
FIG. 3 is a perspective view on the adherent layer of the entrainment plate in accordance with the present invention.

Referring now to the drawing wherein like reference numerals are used throughout the various views to designate like parts, the heat-exchanger disk 11 illustrated in FIG. 1 of a motor vehicle gas turbine (not shown) is made of a glass ceramic material. It includes a large number of small channels 12, through which flow alternately hot combustion gases and combustion air to be heated. The heat-exchanger disk 11 is surrounded coaxially by a toothed rim 14 of alloyed steel under formation of an annular space 13, whereby the toothed rim 14 is rotatably supported in the housing of the motor vehicle gas turbine. The toothed rim 14 serves to drive the heat-exchanger disk 11 and in its turn is driven by a pinion (not shown) of an auxiliary drive of a gas turbine.

The annular space 13 between the heat-exchanger disk 11 and the toothed rim 14 is bridged by compression springs 15 and entrainment plates generally designated by reference numeral 16, which compensate for the differing thermal expansions of these structural parts and which transmit the driving torque from the toothed rim 14 to the heat-exchanger disk 11. For that purpose, each of the compression springs 15 constructed as coil springs abuts under prestress, on the one hand, against the inside 17 of the toothed rim 14 and, on the other, against the outside 18 of an entrainment plate 16 which is curved corresponding to the radius of the heat-exchanger disk 11. For example, 24 compression springs 15 and an equal number of entrainment plates 16 mutually spaced from each other at small distances are uniformly distributed over the circumference of the heat-exchanger disk 11.

The entrainment plates 16 consist each of a sheet-metal support member 19 and of an adherent layer 20 which abuts force-lockingly with its concave inner side 21 at the edge 22 of the heat-exchanger disk 11. The adherent layer 20 consists of metal fibers which form a plastically deformable, felt-like cohesive mass. At its outside 23 facing the sheet-metal support member 19, the adherent layer 20 is non-detachably connected with a wire gauze or meshwork 24. The thickness of the wire is greater than that of the metal fibers so that the adherent layer 20 is considerably reinforced by the wire gauze or wire mesh 24. The adherent layer 20 is secured at the sheet-metal support member 19 by spot welding. As a result of its deformability, the adherent layer 20 can adapt itself well to the heat-exchanger disk 11. The good abutment of the inside of the adherent layer 20 at the edge 22 of the heat-exchanger disk 11, which is achieved thereby, enables a uniform distribution of the spring forces. Together with the high friction value of the metal fibers of the adherent layer 20, this produces a particularly good adherence at the ceramic heat-exchanger disk 11 and therewith a good torque-transmission under all operating conditions.

In particular stainless steel, nickel or alloys are especially suited as material for the adherent layer 20, which, for example, has thicknesses between about 0.5 and about 5 mm. The values for the fiber thickness lie, for example, between about 5 μm and about 300 μm. The porous space in the adherent layer 20 amounts to about 50% to about 90% of the layer volume.

The metal fibers of the adherent layer 20 may be connected with each other into the felt-like coherent mass by sintering in vacuum, for example, at a temperature of about 1,000° Celsius. In a similar manner, also the wire gauze or wire mesh 24 which is constructed, for example, as three-dimensional wire mesh, is non-detachably connected with the metal fibers of the adherent layer 20. During the spot welding of the adherent layer 20, the latter is at first compressed and condensed under the pressure of the electrodes of the welding apparatus and is then welded together with the sheet-metal support member 19 whereby the wire gauze 24 abuts at the support member 19. For example, with an entrainment plate 16 of a length of 85 mm. and of a width of 60 mm. about 15 to 20 welding points 25 are provided each with a diameter of 5 mm. The adherent layer 20, however, may also be fastened at the support member 19 by other fastening methods, for example, by sintering, soldering or brazing.

While I have shown and described only one embodient in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A regenerative heat-exchanger of a gas turbine comprising a ceramic heat-exchanger disk, a metallic toothed rim substantially coaxially surrounding said heat-exchanger disk under formation of an annular space, compression spring means arranged in said annular space, which are supported under prestress, on the one hand, against the inside of the toothed rim and, on the other, against the outside of curved entrainment plate means, said entrainment plate means including a support member and an adherent layer whose concave inner side abuts at the edge of the heat-exchanger disk, characterized in that the adherent layer essentially consists of metal fibers which form a plastically deformable, felt-like adherent layer.

2. A regenerative heat-exchanger according to claim 1, characterized in that the adherent layer of the entrainment plate means is reinforced on its side facing the support member by wire gauze.

3. A regenerative heat-exchanger according to claim 2, characterized in that the adherent layer of the entrainment plate means is secured at the support member by spot-welding.

4. A regenerative heat-exchanger according to claim 3, characterized in that the support member is a sheet-metal support member.

5. A regenerative heat-exchanger according to claim 4, characterized in that the adherent layer has a thickness of between 0.5 mm and 5 mm.

6. A regenerative heat-exchanger according to claim 5, characterized in that the metal fibers of the adherent layer have a thickness of between 5 μm and 300 μm.

7. A regenerative heat-exchanger according to claim 6, characterized in that the adherent layer has a porosity of between 50% to 90%.

8. A regenerative heat-exchanger according to claim 1, characterized in that the adherent layer of the entrainment plate means is secured at the support member by spot-welding.

9. A regenerative heat-exchanger according to claim 1, characterized in that the support member is a sheet-metal support member.

10. A regenerative heat-exchanger according to claim 1, characterized in that the entrainment plate means includes a plurality of individual support members spaced about the periphery of the heat-exchanger disk, and in that individual plastically deformable felt-like adherent layers are secured to the respective support members.

11. A regenerative heat-exchanger according to claim 10, characterized in that a wire gauze is arranged on each of the plastically deformable felt-like adherent layers on sides thereof facing an associated support member so as to reinforce the adherent layers.

12. A regenerative heat-exchanger according to claim 11, characterized in that the compression spring means includes a plurality of compression springs disposed in the annular space with at least one compression spring being arranged between each support member and an inside surface of the toothed rim.

13. A regenerative heat-exchanger according to claim 12, characterized in that each adherent layer has a thickness of between 0.5 and 5 mm.

14. A regenerative heat-exchanger according to claim 13, characterized in that the metal fibers of each adherent layer have a thickness of between 5 μm and 300 μm.

15. A regenerative heat-exchanger according to claim 14, characterized in that each adherent layer has a porosity of between 50% to 90%.

* * * * *